United States Patent [19]

Laskaris

[11] Patent Number: 4,633,682

[45] Date of Patent: Jan. 6, 1987

[54] HORIZONTAL CRYOSTAT INSERT WITH A VERTICAL SERVICE STACK

[75] Inventor: Evangelos T. Laskaris, Schenectady, N.Y.

[73] Assignee: General Electric Company, Schenectady, N.Y.

[21] Appl. No.: 826,058

[22] Filed: Feb. 4, 1986

[51] Int. Cl.[4] ..... F25B 19/00

[52] U.S. Cl. ..... 62/514 R; 62/45

[58] Field of Search ..... 62/45, 514 R

[56] References Cited

U.S. PATENT DOCUMENTS

| | | | |
|---|---|---|---|
| 3,483,709 | 12/1969 | Baicker et al. | 62/514 R |
| 4,516,404 | 5/1985 | Laskaris | 62/514 R |
| 4,522,034 | 6/1985 | Laskaris | 62/514 R |
| 4,535,596 | 8/1985 | Laskaris | 62/514 R |
| 4,562,703 | 1/1986 | Miller et al. | 62/514 R |

*Primary Examiner*—Ronald C. Capossela

*Attorney, Agent, or Firm*—William H. Steinberg; James C. Davis, Jr.; Paul R. Webb, II

[57] ABSTRACT

The insert has a horizontal vacuum jacketed, vapor cooled tube that fits in the cryostat penetration tube. The insert is equipped with a vertical service stack to access cryogenic leads of the cryostat magnet as well as a slanted transfer line to supply liquid helium or couple the insert to a liquifier. Internal radiation shields of the insert are heat stationed to thermal stations of the horizontal vapor cooled tube and the internal shields are also heat stationed to a vapor cooled tube in the vertical stack. A burst disk is provided near the top of the vertical stack as a pressure relief device.

6 Claims, 18 Drawing Figures

11
16
17
21
23a
23b
33
35
37
41
43
45
47
51
53
55
57
59
61
63
64
65
67
71
73
121
135
155
157
161
163
165
167
171
173
175
177
181

HORIZONTAL CRYOSTAT INSERT WITH A VERTICAL SERVICE STACK

CROSS REFERENCE TO RELATED APPLICATIONS

The present application is related to copending applications, Ser. No. 826,049, entitled "Compact Retractable Cryogenic Leads" and Ser. No. 826,051, entitled "Spring Loaded Valve For Adding Cryogenic Liquid To a Cryostat", filed on even date herewith and assigned to the instant assignee.

BACKGROUND OF THE INVENTION

The present invention is generally directed to inserts for horizontal penetrations extending through the outer wall to the inner wall of cryostats, and more particularly to inserts having a vertical service stack and employing liquid helium as a coolant material.

In the generation of images in medical magnetic resonance diagnostic systems, it is necessary to provide a temporarily stable and spatially homogeneous magnetic field. The use of superconductive electrical materials maintained at a temperature below their critical transition temperatures, provides an advantageous means to produce such a field. Accordingly, for such MR imaging devices, a cryostat is employed. A cryostat contains an innermost chamber in which liquid helium, for example, is used to cool the superconductive materials. The cryostat itself, typically comprises a generally toroidal structure with other nested toroidal structures inside the exterior vessel, to provide the desired vacuum conditions and thermal shielding. Since it is necessary to provide electrical energy to the main magnet coil and to various correction coils employed in MR imaging and to replenish coolant material, it is necessary that there be at least one penetration through the cryostat vessel walls.

Present MR magnets with horizontal tube penetrations require two separate plugs, one to power the magnet as described and claimed in U.S. Pat. No. 4,535,596 and another plug to be used when the magnet is operating in the persistent mode providing high thermal efficiency as described and claimed in U.S. Pat. No. 4,516,404. The procedure to remove and insert these plugs is complex, requires the training of operators and can inadvertently admit air inside the cryostat. The use of a helium liquifier, which captures helium boiloff and returns liquid helium to the cryostat, with these plugs could result in contamination of the liquifier because of the admission of air into the system.

A horizontal cryostat penetration has the advantages of simplifying manufacturing, being easier to support during shipping, providing more overhead room and allowing easy access for service. A single penetration insert is highly desirable for servicing the magnet for all the required operations including cooldown, excitation, persistent mode operation, and shimming.

It is an object of the present invention to provide a single horizontal penetration insert with a vertical service stack through which the magnet can be powered or operated in a persistent mode without admitting air inside the helium vessel.

It is a further object of the present invention to provide a single horizontal penetration insert to function as an interface between the cryostat and a helium liquifier.

SUMMARY OF THE INVENTION

In one aspect of the present invention an insert is provided for a cryostat having a horizontal penetration, where the cryostat has an inner supercoolable vessel, an outer wall, at least one radiation shield situated between the supercoolable vessel and the outer wall and electrical leads extending through said cryostat penetration to the exterior of the cryostat. The insert comprises an outer tubular low thermal conductivity housing including a generally horizontal portion having a first and second section. The first section has an open end which is adapted to be inserted inside the horizontal penetration, extending therebeyond to the inner supercoolable vessel. The first and second sections of the insert are adapted to surround the electrical leads extending from the cryostat. The outer tubular housing further includes a first tubular portion extending vertically from the second section of the horizontal portion so that access to the electrical leads outside the cryostat can be provided. A second tubular portion extending perpendicularly from the second section of the horizontal portion of the outer housing is also provided. A cover is secured to the top of the vertical tubular portion. An inner housing is situated inside the outer tubular housing with the inner housing defining an opening at the end of the first section of said horizontal tubing. The open ends of the inner housing and outer tubular housing are joined together with the inner housing adapted to surround the cryostat electrical leads. The inner housing extends part way up the vertical tubular portion and opens into the vertical tubular portion. Two concentric tubes are situated in the first and second section of the inner housing and extend beyond the end of the first section of the outer tubular housing. The concentric tubes are adapted to fit through the cryostat electrical leads and extend into the supercoolable cryostat vessel. The outer concentric tube has holes in the portion situated in the second section. A vent tube is situated in the second tubular portion of the housing. The vent tube penetrates the inner housing and is in flow communication with the outer of the two concentric tubes. Means for coupling liquid helium to said inner concentric tube through the slant tube is provided. A radiation shield is situated between the horizontal portion of the outer housing and the inner housing. The shield extends partway up the vertical stack and is heat stationed to the inner housing part way up the stack. Electrical connection means extend through the cover down the vertical tubular portion. The electrical connection means are adapted to be coupled to the cryostat electrical leads.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with the accompanying drawing figures in which:

DETAILED DESCRIPTION OF THE INVENTION

Figure 1:
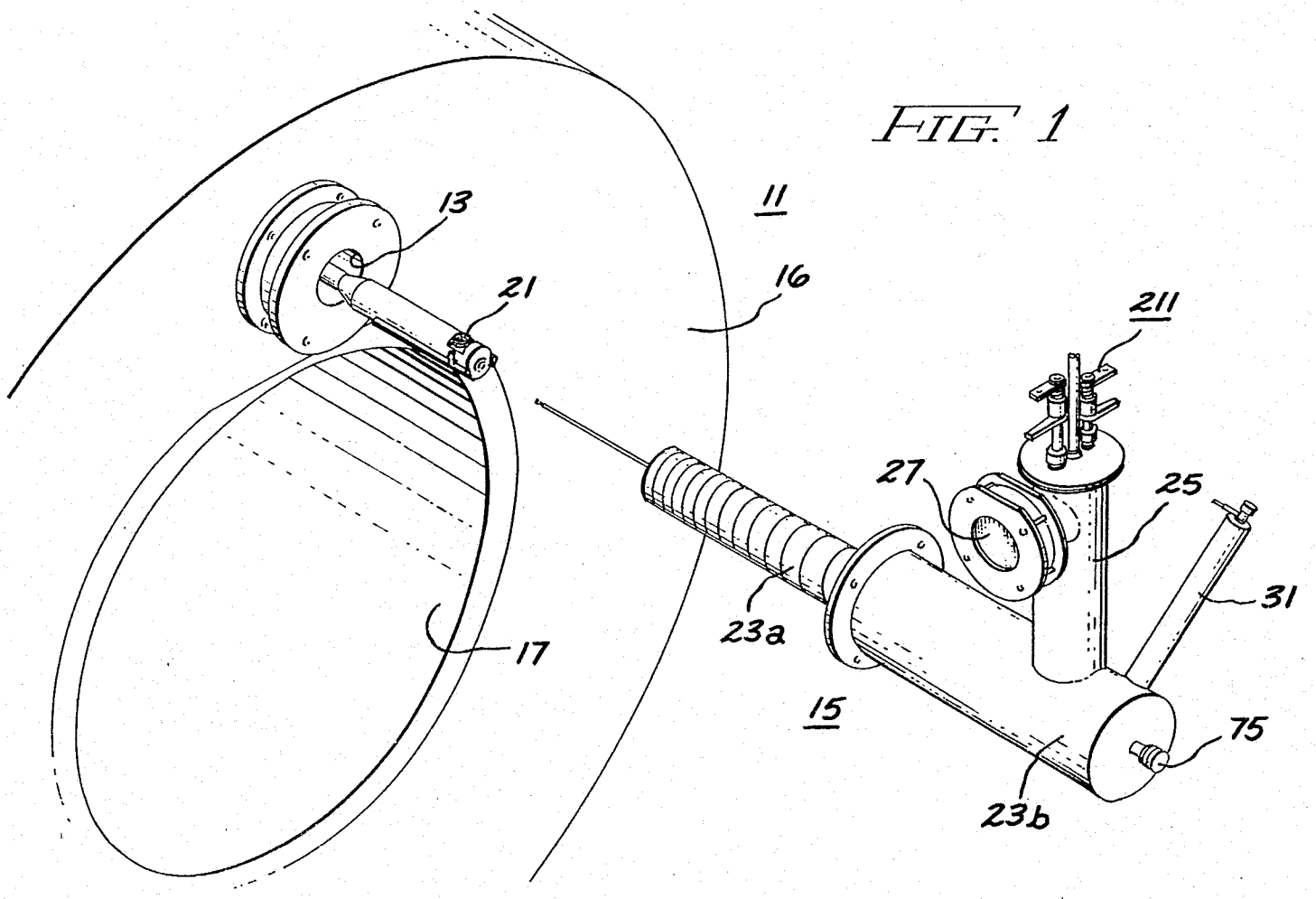
FIG. 1 is an exploded isometric view of a cryostat and a cryostat insert in accordance with the present invention.

Referring now to the drawing wherein like elements are indicated by like numerals throughout and particularly FIG. 1 thereof a cryostat 11 defining a cryostat penetration 13 together with a cryostat insert 15 are shown. The cryostat 11 comprises a cylindrical shaped vessel 16 defining a horizontal bore 17 therethrough, suitable for use in magnetic resonance imaging systems. Extending from the cryostat 11 through the cryostat penetration 13 is an electrical lead assembly 21 providing connections to a superconducting magnet and shimming coils inside the cryostat 11.

The cryostat insert 15 comprises a horizontal tubular outer housing having a first portion **23*a* which is adapted to be inserted in the cryostat penetration 13 and a second portion 23*b* which remains outside the cryostat when the first portion is inserted. Extending radially in the vertical direction from the second portion of the external housing is a vertical stack 25, having a burst disk 27 extending perpendicularly from the top end of the stack. A slanted liquid helium transfer tube housing 31 also extends radially from the second portion 23*b* of the tubular housing, longitudinally separated from the vertical stack 25** and extending at a 45° angle, measured about the longitudinal axis of the horizontal tube from the vertical stack.

Figure 2:
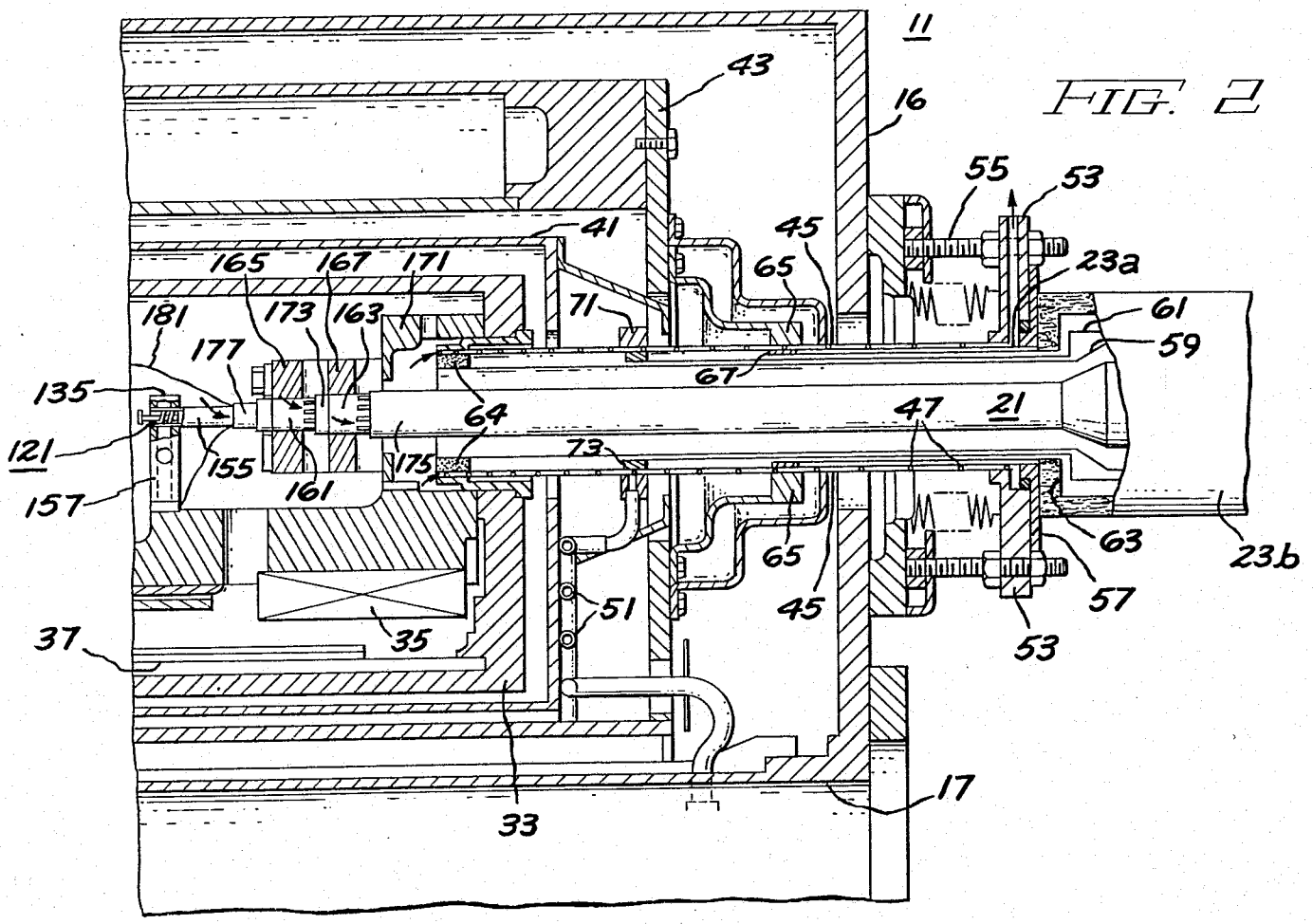
FIG. 2 is a partial cross sectional view of the insert positioned in the cryostat penetration.

Referring now to FIG. 2 a portion of the cryostat 11 with the insert in position inside the cryostat penetration 13 is shown. The cryostat comprises an inner annular helium vessel 33 which contains magnet windings 35 of superconductor wire for generating a magnetic field as well as shimming coils 37 for field correction. The cryostat penetration extend into the upper portion of the helium vessel.

The helium vessel 33 is surrounded by an intermediate shield 41 cooled by helium vapor boiloff and maintained at a temperature below 40° K. The intermediate shield is surrounded by a nitrogen vessel 43 which also serves as a shield and maintains a temperature of approximately 80° K. due to nitrogen cooling.

The first portion of the horizontal tubular housing **23*a* extends into the cryostat through a cryostat penetration tube 45 which is part of cryostat. Penetration tube 45 defines the cryostat penetration 13 as well as extending outside the cryostat. A clearance gap is created between the outside of the first portion of the tubular housing 23*a* and the inside of the cryostat penetration tube 45, where helium vapor form the helium vessel 33 flows and intercepts heat conducted through the tube 45 and the insert portion 23*a* from the ambient temperature outside the cryostat. The gap extends from the ambient to the inside of the helium vessel 33. The flow of helium vapor through the gap is guided by means of two or more variable pitch spiral Teflon® insulated wires 47 that are wrapped around the external housing of the insert 23*a*. When two wires are used, they start on opposite sides on the housing and spiral around spaced apart from one another. The spiral flow of helium vapor suppresses the secondary flow that could be induced in the gap as a result of the helium density gradient from 4° K. to 300° K. Vapor cooling of the penetration tube 45 and the insert housing tube 23*a* is the most effective way to reduce the heat transferred to the liquid helium in the helium vessel 33. A portion of the helium vapor flowing in the gap is diverted to flow through a spiral of aluminum tubes 51 adjacent to and in contact with the flat circular end of the cylindrically shaped intermediate shield 41. The remaining helium vapor continues along the gap between the outer housing 23*a* and the inside of the cryostat penetration tube 45 and is vented through a hole in a flange 53 welded to the outside of penetration tube 45 that extends beyond the cryostat. Flange 53 is supported by bolts 55 from the exterior of the cryostat. A flange welded around the outside of the outer housing 23*a* of the insert is bolted to the cryostat flange 53**.

A 4° K. isothermal envelope 59 surrounds the electrical lead assembly 21 extending from the cryostat. The 4° K. envelope is in flow communication with the interior of helium vessel 33. To reduce radiation heat transfer from the ambient temperature of the outside of the tubular housing **23*a* to a 4° K. isothermal envelope 59, two copper thermal radiation shields 61 and 63 are employed each of which surround the 4° K. envelope. In addition, a vacuum is maintained between the outer tubular housing 23 and the 4° K. envelope 59. Getter material 64 is situated in the end of the first portion of the housing where the outer housing is welded to the 4° K. envelope. The getter material serves as a molecular sieve to absorb gases that would degrade the vacuum. Gases including helium and air might enter the vacuum due to metal porosity or small leaks at welded joints. The inner radiation shield 61 of the insert is heat stationed to the intermediate shield 41 of the cryostat by means of a copper ring 71 which surrounds the penetration tube 45. A copper ring 73 located inside the insert 15 is situated concentric with copper ring 71. Copper ring 73, conducts heat from the inner shield 61 of the insert to ring 71 and to the intermediate shield 41. Conduction cooling occurs between the inner shield 61 of the insert and the cryostat intermediate shield 41 to maintain a temperature below 40° K. at the inner shield 61. Similarly, outer radiation shield 63 is heat stationed to the nitrogen vessel 43 by means of a copper ring 65 surrounding the penetration tube 45. Tube 45 is concentric with a copper ring 67 situated inside the horizontal housing 23*a*. Ring 67 conducts heat from the outer shield 63 to ring 65 and then to the nitrogen shield 43. Conduction cooling occurs between the outer radiation shield 63 and the cryostat nitrogen vessel, maintaining an 80° K. outer radiation shield temperature. The heat stations which comprise copper rings 65 and 71 are also cooled by convection heat transfer to the helium vapor through spiral flow passages defined by wires 47 surrounding the first portion of the horizontal tubular housing 23***a*.

Figure 3:
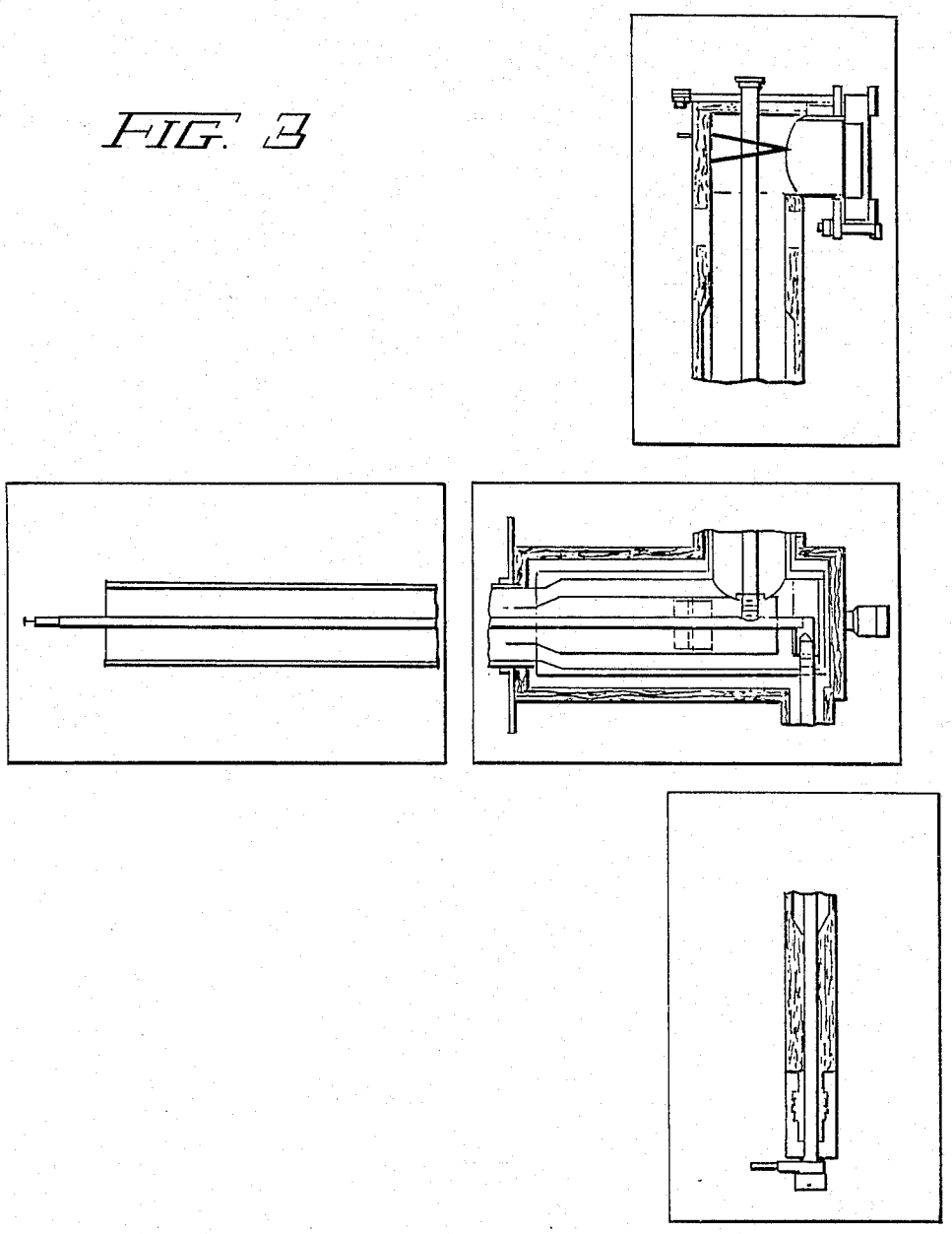
FIG. 3 shows the relationship of FIGS. 4A, B, C and D.
Figure 4A:
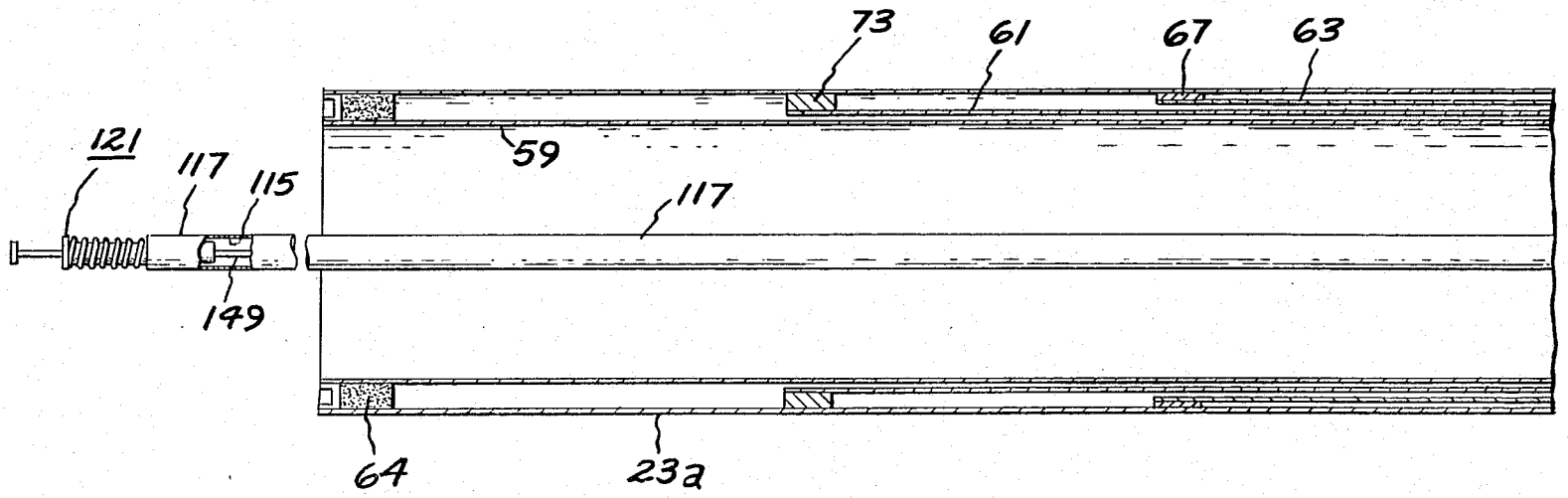
FIGS. 4A, B, C and D together show a cross-sectional view of the cryostat insert with selected parts rotated to more easily show features in cross section.
Figure 4B:
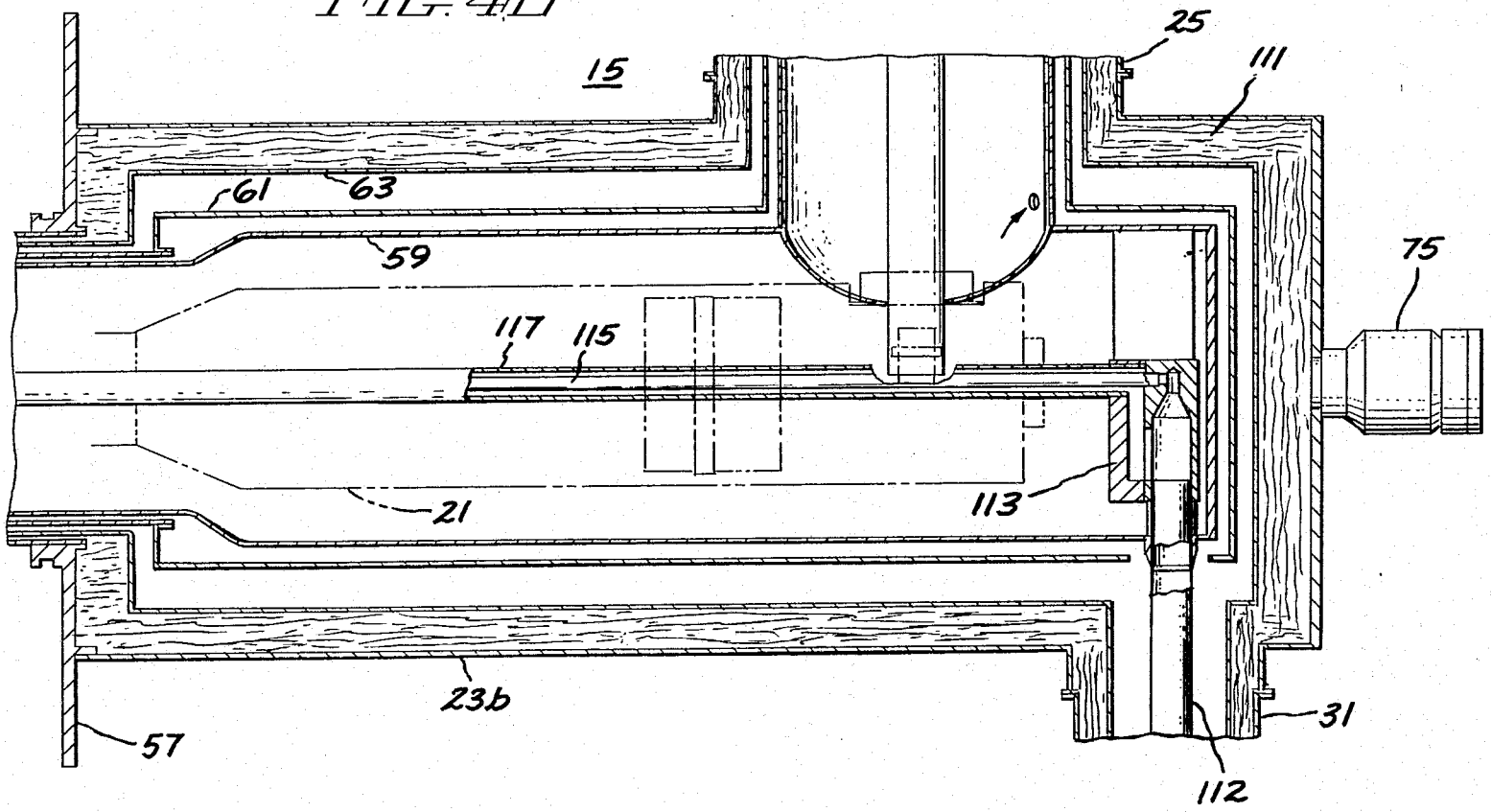
Figure 4C:
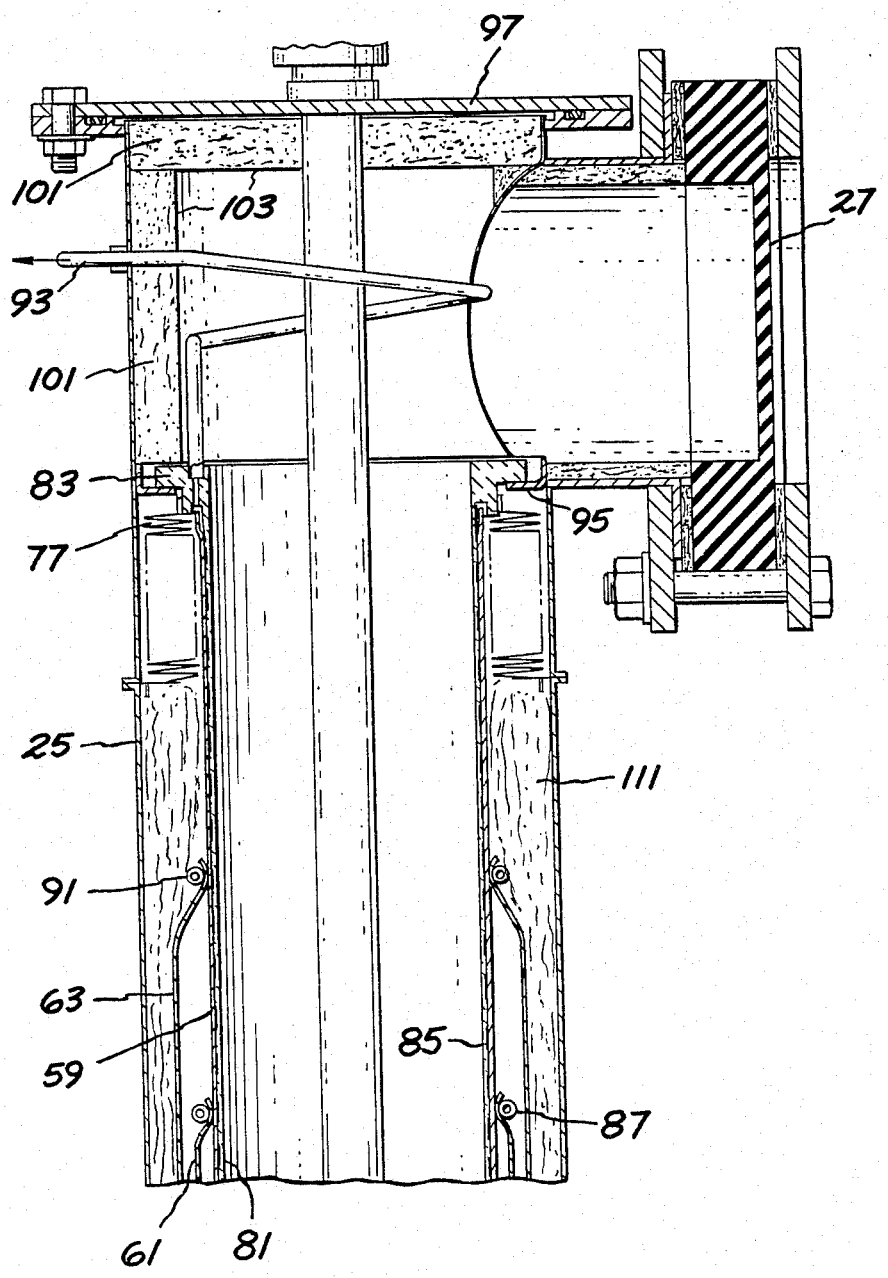
Figure 4D:
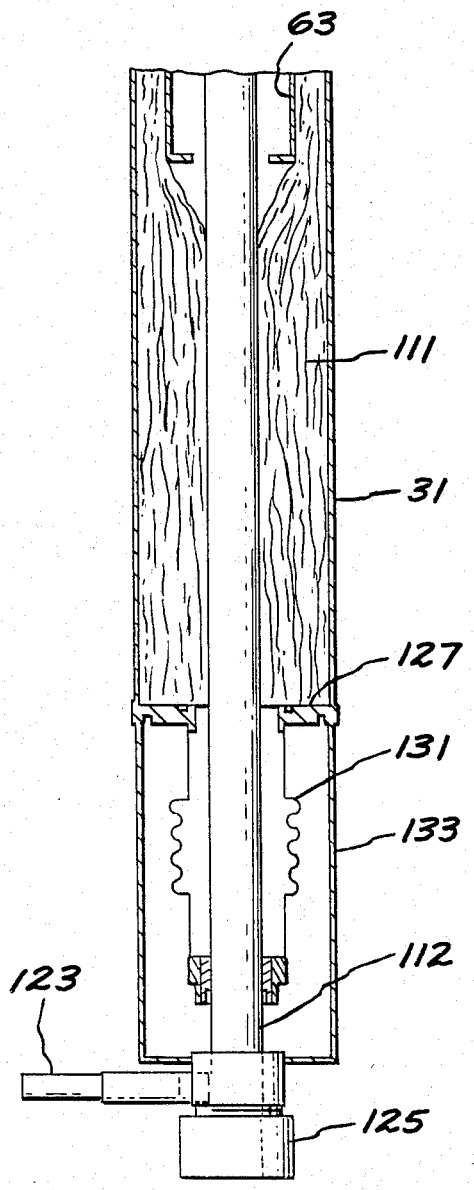
Figure 5:
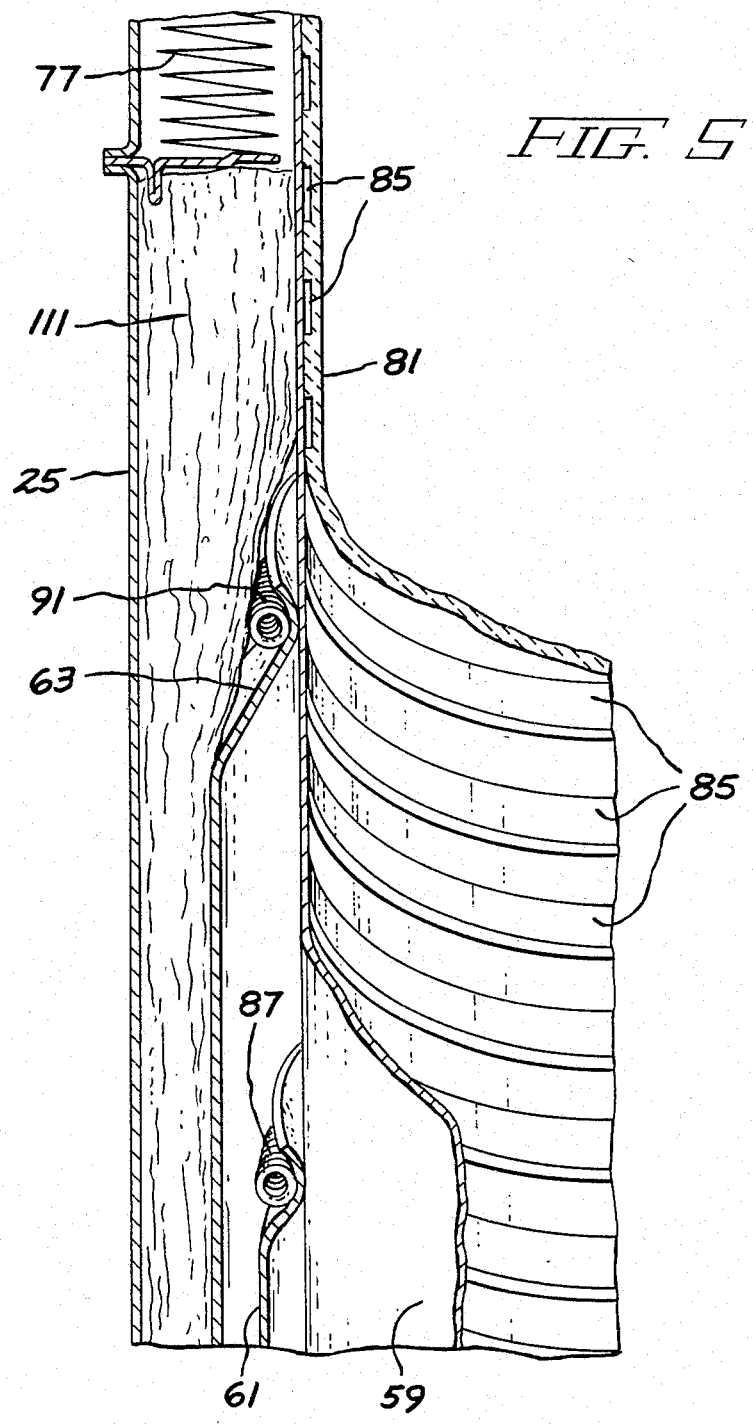
FIG. 5 is a partial cutaway view showing in a more detail a portion of FIG. 4C.

Referring now to FIGS. 4A, B, C and D, the insert 15 is shown in cross section prior to insertion in the cryostat with FIGS. 4A, B, C, and D arranged as shown in FIG. 3. The electrical lead assembly 21 is shown in phantom. For ease of illustration in cross section, the burst disk 27 has been rotated 90° about the vertical axis of the vertical stack 25 and the slanted liquid helium fill tube housing 31 has been rotated about the longitudinal axis of the horizontal tubular housing 23*a* and *b*, as compared to their actual position shown in the isometric view of FIG. 1.

The space between horizontal tubular housing 23*a* and *b* and the 4° K. envelope 59 forms an evacuable jacket around the 4° K. envelope 59 which can be evacuated at pump out port 75, located at the exterior end of horizontal housing 23*b*. The radiation shields 61 and 63 are spaced apart from one another, the 4° K. envelope 59 and the outer housing 23 to avoid conduction thereamong. The copper radiation shields 61 and 63 each comprise a cylindrical tube located in housing portion 23*a* which transitions to a larger cylindrical tube in housing portion 23*b*. The two tubes of each of the shields are joined by transition pieces all of which are joined together by soldering. The 4° K. envelope extends vertically inside the vertical service stack where it is affixed to the outer wall by a cylindrical bellows which surrounds the upper portion of the 4° K. tube. The envelope is joined to the upper end of the bellows and the lower end of the bellows is affixed to the outer wall of the service stack. The connection using bellows 77 provides flexible support of the 4° K. vapor cooled extension in the vertical stack that will maintain a sealed vacuum jacket.

Referring now to FIGS. 4A, B, C and D, and 5, vapor cooling of the extension of the 4° K. envelope in the vertical stack is accomplished by a fiberglass tube 81 having a flange 83 on its upper end and a spiral groove 85 on its outer surface. The fiberglass tube 81 is bonded to the inside of the extension of the 4° K. envelope 59, forming a spiral passage extending up the inside of the stack, providing vapor cooling of the 4° K. envelope extension. Inner shield 61 extends partway up the vertical stack and is secured around the 4° K. envelope extension by a spring 87 of the type shown in U.S. Pat. No. 4,562,703, heat stationing that portion of the vertical stack. U.S. Pat. No. 4,562,703, entitled "Plug Tube for NMR Magnet Cryostat", and assigned to the instant assignee is hereby incorporated by reference. Further up in the tube the outer shield 63 is secured around the vapor cooled 4° K. envelope extension by a spring 91. The shields are conduction cooled by convection heat transfer to the helium vapor through the spiral flow passages. The helium vapor from the spiral flow passages is vented at the top of the stack via tube 93.

The copper radiation shields 61 and 63 each comprise cylindrical tube sections located in housing 23*a* which transition to larger cylindrical tubes in housing 23*b*, ending with end plates closing the end of the tubes. The cylindrical tubes open into and extend the shields up into the vertical stack. Shield 63 has an additional cylindrical tube section extending partway into the slanted fill tube 31. All the sections of each of the shields are joined together, preferably by soldering.

A cylindrical bellows 77 is affixed at its lower end to the housing wall 25 and at its upper end to the top edge of the 4° K. envelope creating a vacuum tight enclosure between the terminator of the 4° K. envelope in the vertical stack and the housing wall.

The bellows 77 accommodates the axial thermal contraction of the 4° K. envelope in the horizontal portion of the insert relative to the housing of the vertical stack. The vacuum insulation between the exterior of the 4° K. envelope and the interior of the housing results in a vertical unbalance force on the vertical extension of the 4° K. envelope in the vertical stack which could overstress the welds of the horizontal portion of the 4° K. envelope. To reduce stress on the horizontal portion of the 4° K. envelope, a retainer ring 95 is welded to the inside of the vertical portion of the housing above the bellows 77 to support the flanged end 83 of the fiberglass tube 81 which in turn supports the vertical extension of the 4° K. envelope.

To reduce the radiation heat transfer to the liquid helium inside the 4° K. envelope, the inside of the outer vertical housing above the bellows 77 and a cover 97 situated over the top of the stack are lined with foam insulation 101. Aluminum foil 103 is bonded on the inside surface of the foam insulation to serve as a reflective surface. The inside surface of the fiberglass tube is painted black to absorb all the thermal radiation emitted from the reflective surface. Burst disk 27 is located near the top of the vertical stack to serve as a pressure relief device. The top cover 97 has apertures which permit retractable leads 105, 107 and 109 to pass therethrough, which power and shim the magnet 35 in the cryostat 11.

Multilayer insulation 111 is wrapped around the 80° K. shield in the exterior portion 23*b* of the insert 15 to reduce radiation heat transfer. Also, the vacuum side of the 4° K. envelop and the housing 23*a* and 23*b* as well as both radiation shields 61 and 63 are silverplated to reduce their emissivity.

The slanted liquid helium transfer tube housing 31 (shown rotated in FIG. 4 from its actual position as shown in the isometric view of FIG. 1) has a tube 112 coaxial with the outer housing 31. The end of the tube 112 extends inside the insert and terminates in a housing 113 located inside the 4° K. envelope 59. Tube 112 penetrates the 4° K. envelope, with the 4° K. envelope soldered around tube 112. Tube 112 is in flow communication with two concentric horizontal tubes 115 and 117 which extend the entire horizontal length of the insert and extend from the end of the tubular housing that is inserted in the cryostat, terminating in a spring loaded valve 121. The inner horizontal tube 115 is a liquid helium fill tube and the outer concentric tube 117 is a helium vapor return tube. The tube 112 is coupled to a bleed off nozzle 123 at the exterior portion of the insert. Also coupled to tube 112 is a quick-seal connector 125 which allows a helium filler pipe (not shown) to be inserted through the connector 125 and extend down the inside of tube 112 to the housing 113 allowing liquid helium to flow to the inner tube 115 of two concentric tubes 115 and 117, but blocking the passage of liquid helium from reaching the outer tube 117 through housing 113. The two concentric tubes extend through a horizontal aperture at the center of electrical leads assembly 21 extending from the cryostat, shown in phantom in FIG. 4. The inner radiation shield 61 does not extend into the slanted liquid helium transfer tube housing 31. The outer radiation shield 63 extends only partway into the housing 31. Multilayer insulation surrounds tube 112 and extends into the housing 31. To maintain the vacuum surrounding tube 112, a collar 127 is welded to the inside of the housing vertical wall, partway up the slant tube. The tube 112 extends through the collar 127 and through a bellows 131 one end of which is brazed to the inside diameter of the collar. The other end of bellows 131 is brazed to tube 112 forming a vacuum seal, while allowing relative movement between the housing 31 and the tube 112. The portion of tube 112 extending beyond the collar 127 and surrounded by the bellows 131 is enclosed by a cover 133.

Figure 6A:
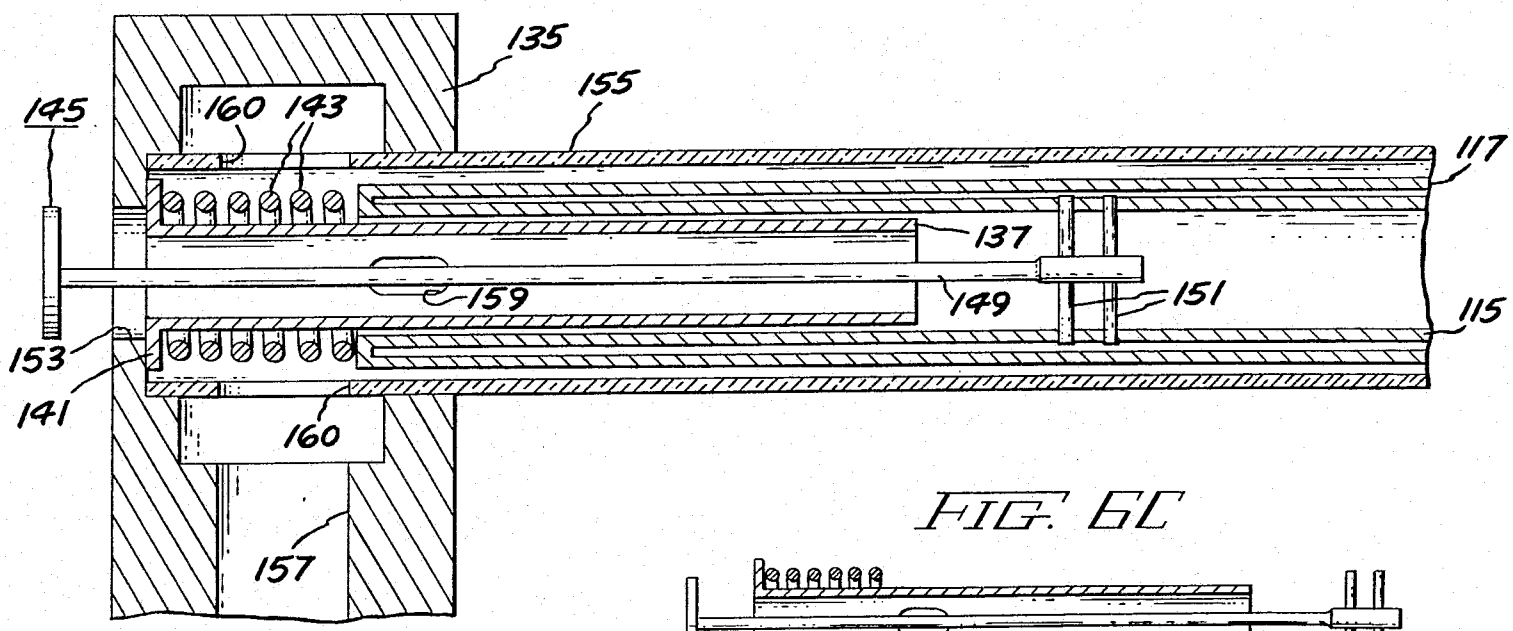
FIGS. 6A and 6B show a cross sectional view of a spring loaded valve on the end of a liquid helium fill tube situated in the cryostat, with the valve in open and closed position, respectively.
Figure 6C:
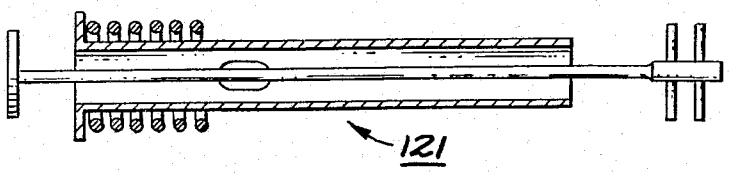
FIG. 6C shows a cross-sectional view of the spring loaded valve of FIGS. 6A and B.

Referring now to FIGS. 6A, B which show the spring loaded valve 121 situated in the cryostat fill tube termination block 135 in the open and closed positions, respectively, and FIG. 6C which shows the spring loaded valve, the spring loaded valve 121 comprises a sleeve 137 having a flange 141 at one end. The other end of sleeve extends partway inside the end of liquid helium fill tube 115. A spring 143 surrounds sleeve 137 and is captured between the flange 141 and the welded end of tubes 115 and 117. A valve 145, comprising a valve head 147 and valve stem portion 149, has its valve stem portion extending partway down the center of inner tube 115 and held in the tube by pins 151 extending through the walls of the tube 115 and through the stem 149. The head 147 of the valve has a diameter larger than tube 137, retaining the sleeve 137 in the end of tube 115 when the insert is not situated in the cryostat. The flange 141 however has a larger diameter than head 147, permitting the head to pass through an aperture 153 in block 135, but not the flange 141.

An epoxy glass tube 155 extends from the cryostat fill tube termination block 135 through the cryostat electrical lead assembly 21, forming the inner diameter of the electrical lead assembly (see FIG. 2). The epoxy glass tube 155 surrounds the horizontally extending concentric liquid helium fill tube 115 and the vapor return tube 117 when the insert is positioned in the cryostat.

Referring now particularly to FIG. 6A, the spring loaded valve 121 is shown in the open position. Valve head 147 extends through the aperture 153 in the termination block 135. The spring 143 is compressed when progress of sleeve 137 through the block is stopped during insert installation by flange 141 which contacts the wall surrounding aperture 153. With the valve open liquid helium flowing in the inner concentric tube 115 can be supplied to the top of the magnet through aperture 153.

Figure 6B:
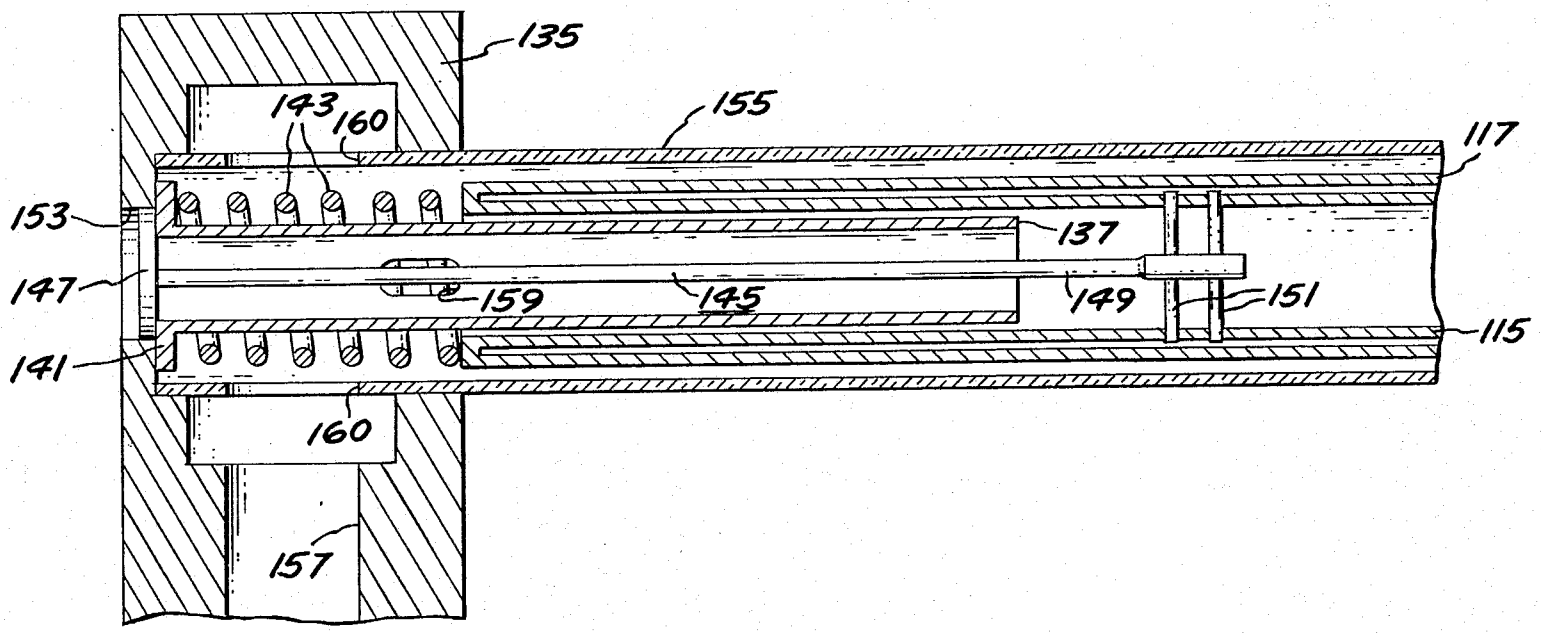

Referring now to FIG. 6B, the spring loaded valve 121 is shown in the closed position, which can be used during initial magnet cooldown. The spring loaded valve 121 is closed by retracting the insert ¼" by adjusting bolts 55 moving flange 53 further from the cryostat. Retracting the insert causes concentric tubes 115 and 117 to be retracted, which in turn retracts the valve head 147 inside the termination block aperture 153, closing aperture 153. Sleeve 137 does not retract since it is still held against the termination block by spring 143. Holes 159 in tube 137 are exposed allowing liquid helium to flow from tube 115 to holes 159 in tube 137 to holes 160 in the epoxy tube 155 to a chamber in the termination block which is in flow communication with a tube 157 leading to the bottom of the helium vessel 33.

Figure 7:
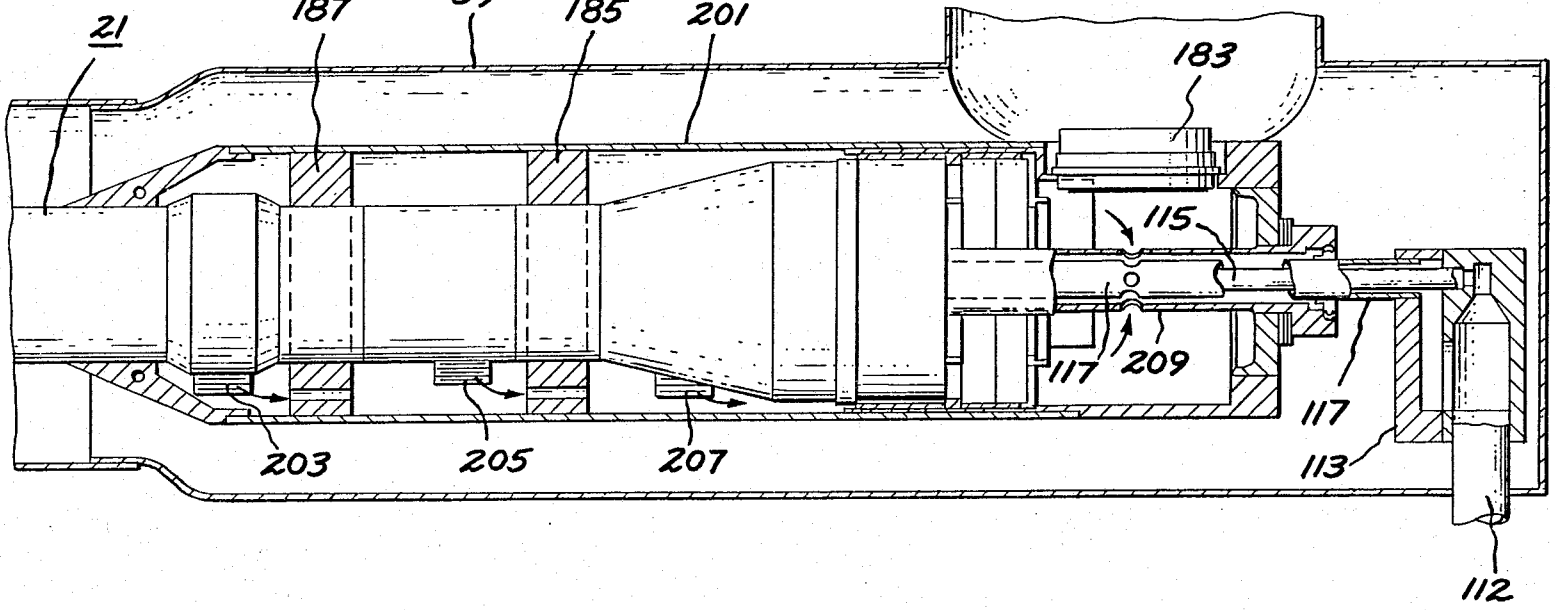
FIG. 7 is a partial cutaway cross sectional view of the horizontal portion of the 4° K. isothermal envelope located in the exterior portion of the insert, when the insert is situated in the cryostat.

Referring again to FIGS. 2 and 7, the insert is shown in cross section after insertion in the cryostat. FIG. 7 shows only the portion of the 4° K. envelope and its contents which are located in housing portion 23*b*. The electrical lead assembly 21 includes two main power leads 161 and 163 (see FIG. 2) comprising concentric copper tubes with longitudinally extending slots on the outside surface of the tubes for vapor cooling. The leads 161 and 163 are cantilevered from rectangular shaped copper terminals 165 and 167 surrounding the tubes located on the magnet support structure 171 of the cryostat. An electrical insulating tube 173 is positioned between the two power lead tubes 161 and 163 and another electrical insulating tube 175 surrounds both copper tubes 161 and 163. An electrical insulating tube 177 extends inside the inner power lead tube 161. Correction coil leads 181, which are part of the electrical lead assembly, extend through the annulus formed between the outside of the epoxy tube 155 and the inside of the insulating tube 177.

Figure 8A:
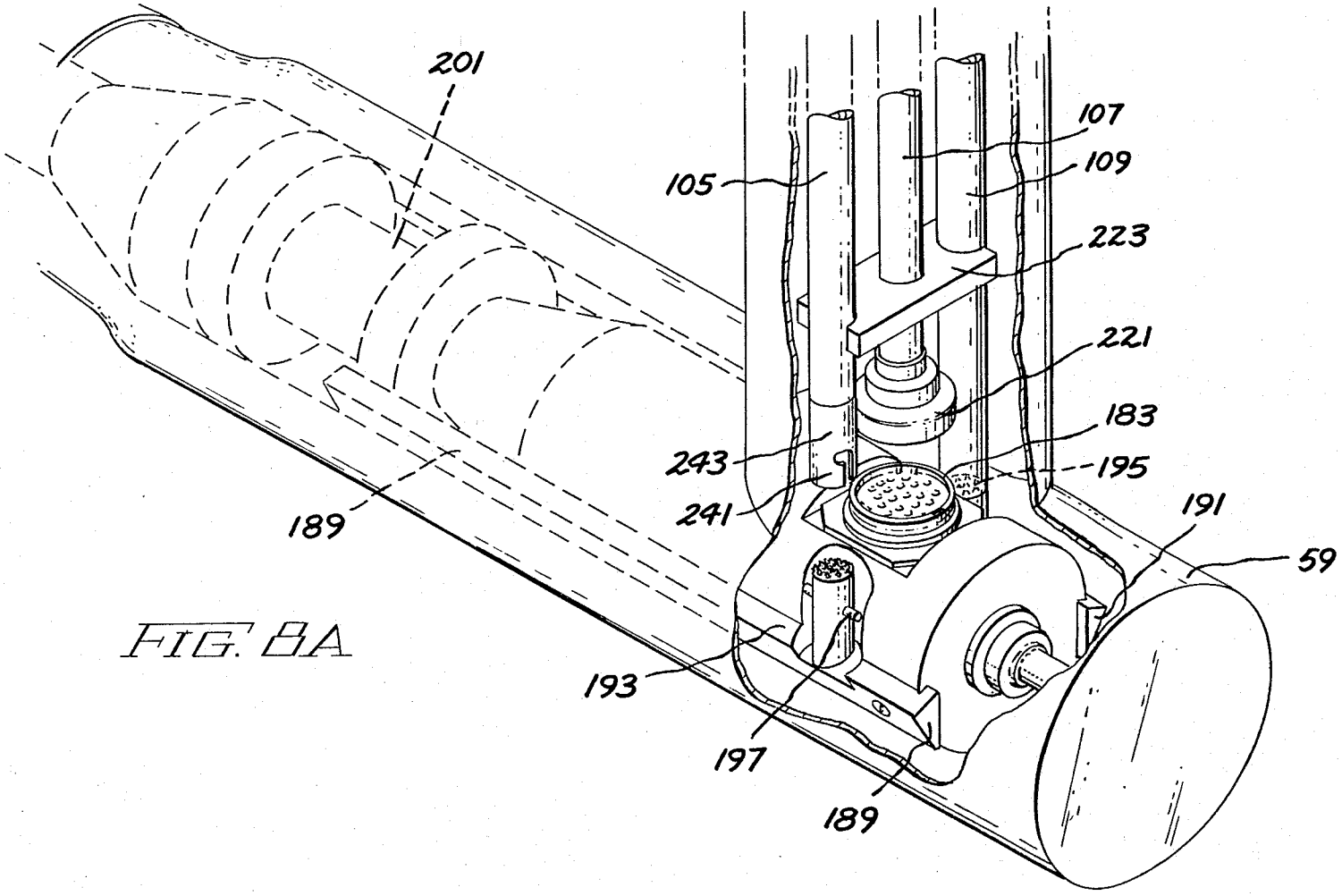
FIG. 8A and B are the lower and upper portions, respectively, of a partially cutaway isometric view of the exterior portion of the horizontal 4° K. envelope, part of the vertical 4° K. envelope extension and the vertical stack cover including the retractable lead assembly, when the insert is situated in the cryostat.
Figure 8B:
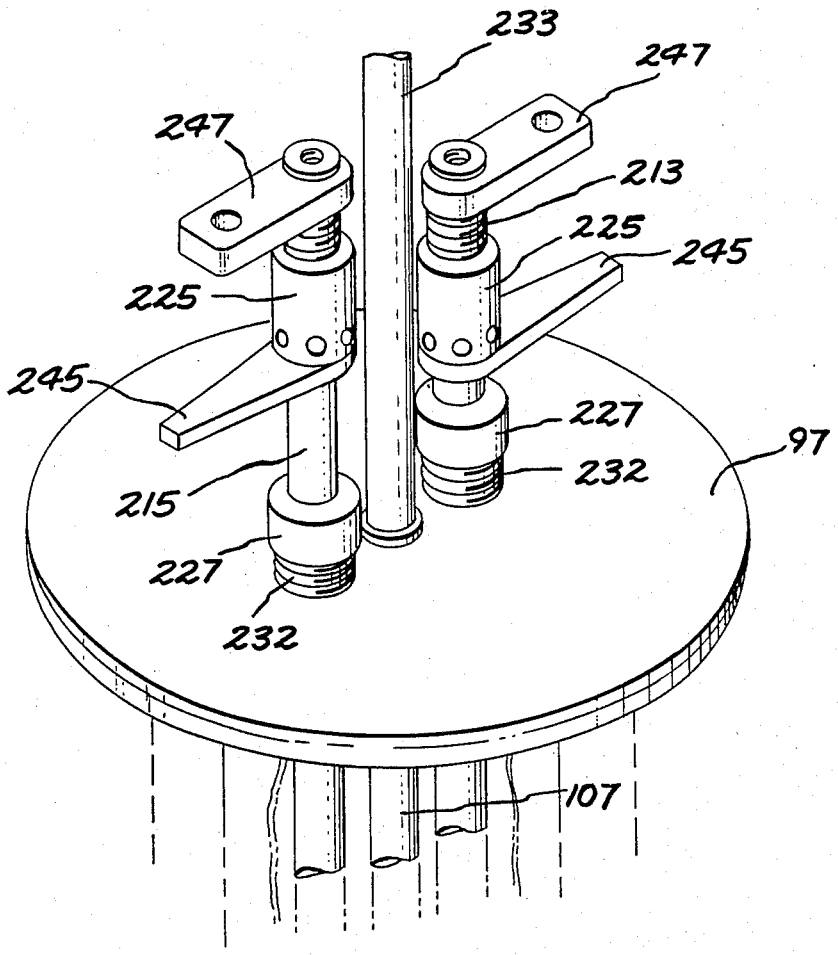

Referring now to FIGS. 7 and 8A where FIG. 7 shows only the portion of the 4° K. envelope and its contents located in housing portion 23*b* when the insert is inserted in the cryostat and FIG. 8A is an isometric view of FIG. 7 together with the lower portion of the 4° K. envelope in the vertical stack, the correction coil leads 181 are shown connected to a multipin connector 183 situated at right angles to the electrical lead assembly, with the multipin connector pointing upward. In the portion of the electrical lead assembly outside the cryostat, the concentric copper tubes 161 and 163 terminate in staggered rings 185 and 187 which by means of bus bars 189 and 191 are coupled to vertical terminal rods 193 and 195, respectively, situated on either side of the multipin connector, radially opposed from one another. The vertical terminal rods 193 and 195, each have a horizontal pin 197 and 199 (not shown), respectively, extending through the rod and beyond the rod on either side. The copper rings 185 and 187 are enclosed by an electrical insulating sleeve 201 which leaves the multipin connector 183, bus bars 189 and 191 and vertical terminal rods 193 and 195 uncovered. Insulating sleeve is part of the electrical lead assembly 21 of the cryostat.

Referring now to FIGS. 2, 7 and 8A, cooling of the main power leads 161 and 163 and correction coil leads 181 is accomplished by helium vapor flow originating in the cryostat helium vessel 33 as indicated by arrows in FIGS. 2 and 7. The helium vapor flows in the annulus containing the correction coil wires, and in the longitudinal slots of the main power leads. The vapor is discharged in the chamber created by the insulating sleeve 201. Pipe 203 provides a discharge outlet for vapor traveling in the slots of the outside main power lead 163, pipe 205 provides a discharge outlet for vapor traveling in the slots of the inner main power lead 161 and pipe 207 provides a discharge outlet for vapor cooling the correction coil leads 181. The vapor passes through holes in a pipe 209 which surrounds the two concentric tubes 115 and 117 and then through holes in helium vapor return tube 115 to housing 113 which is in flow communication with tube 112 inside the slanted helium transfer tube housing 31. Tube 209 is part of the cryostat lead assembly 21.

The cryostat insert which has the concentric liquid helium tube 115 and helium vapor tube 117 extending through the electrical lead assembly 21 and the 4° K. envelope 59, shields 63 and 61, multilayer insulation 111 and outer housing 23*b* surrounding it, provides thermal insulation to the leads and access through the vertical stack 25 of the insert to the multipin connector 183 and vertical terminal rods 193, and 195.

Figure 9:
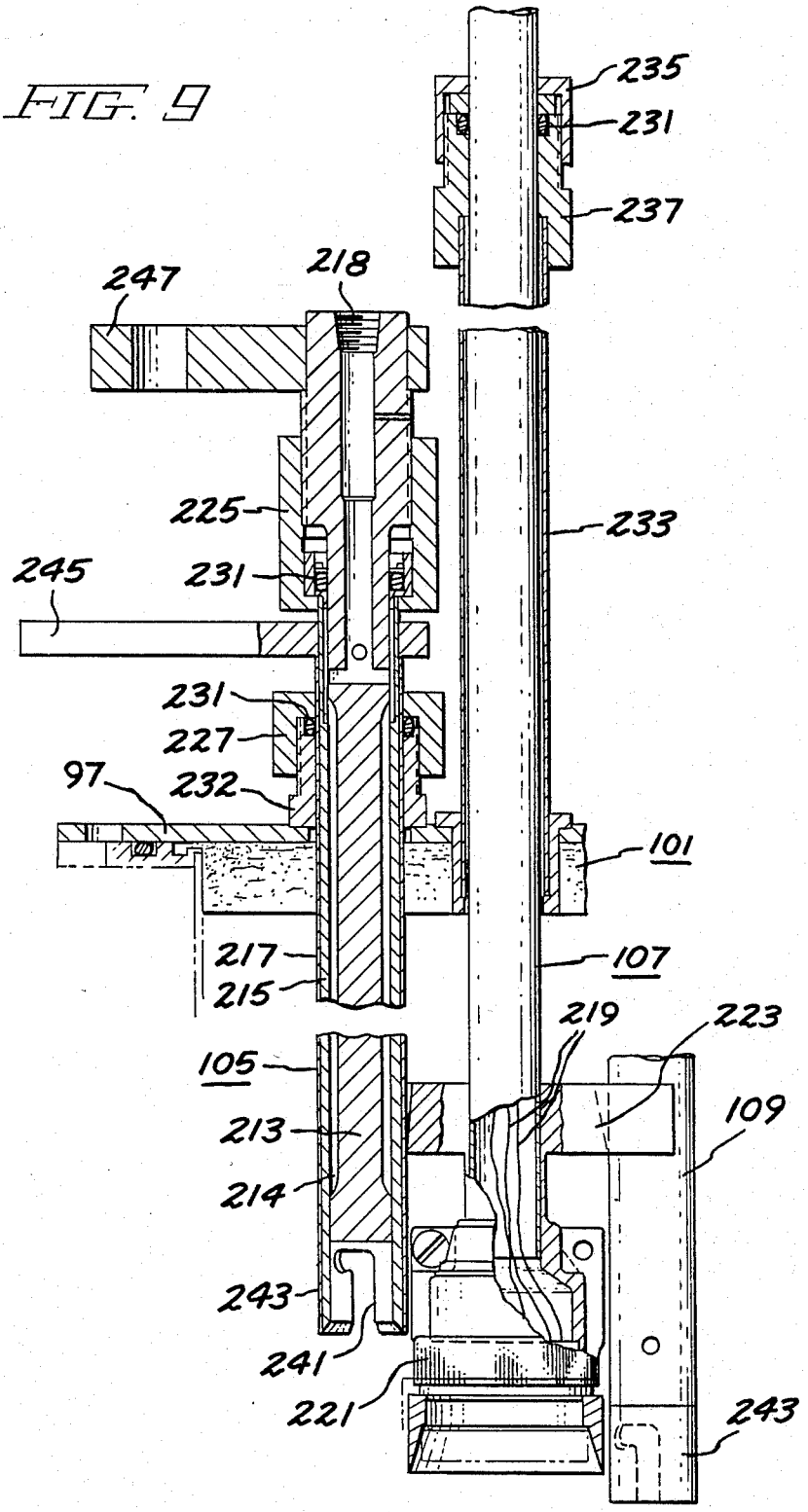
FIG. 9 is a partial cross sectional view of the retractable lead assembly in accordance with the present invention.

Referring now to FIGS. 8A and B, and FIG. 9 a retractable lead assembly 211 is shown, which comprises two power leads 105 and 109 each including a copper rod (shown in FIG. 9) with axial cooling slots 214 surrounded by a stainless steel tube 215 and insulated by a fiberglass sleeve 217 bonded on the outside surface of the stainless steel tube 215. The axial cooling slots are in flow communication with a vent 218 in the center of the copper rod portion that extends outside of the vertical stack. The vent 218 is connected to a flow meter and valve (not shown) which screws in the threaded aperture of the vent. The retractable lead assembly also includes a conduit 107 containing a cable of wires 219 connected at the lower end to a multipin connector 221 located inside the insert and at the upper end to another multipin connector outside the insert (not shown). The retractable lead assembly 211 has conduit 107 extending through the center of the vertical stack cover 97 with the power leads 105 and 107 extending through the vertical stack cover 97 on either side of conduit 107. The three leads 105, 107 and 109 are spaced apart inside the vertical stack by a horizontal guide bar 223. The conduit 107 passes through and is secured to, the guide bar 223. The two power leads 105 and 109 slide in tapered notches located on either end of the guide bar 223. The copper rods 213 inside of each of the power leads 105 and 109 slide relative to the surrounding stainless steel tube 215, within the constraints imparted by nuts 225 situated outside the vertical service stack. Nuts 225 are rotatably captured by the stainless steel tube 215 of each of the power leads 105 and 109, respectively, and threadingly engage the copper rods 213 in each of the stainless steel tubes 215. Power leads 105 and 109 are surrounded by a cap nut 227 which has an internal seal 231 which surrounds the power leads to allow the power leads to slide through the cover 97 without admitting air to the insert. The cap nut is threadingly engaged with a nipple 232 which is brazed to the cover. To allow sliding motion of the conduit 107, the conduit 107 extends through a pipe 233 soldered to the top of the cover and passes through a cap nut 235 which has an internal seal 231 which surrounds the conduit. Cap nut 235 is threadingly engaged with a nipple 237 which is brazed to pipe 233.

The bottom end of each of the power leads 105 and 109 has a bayonet socket 241 defined by the stainless steel tube 215. An additional stainless steel tube 243 surrounds the stainless steel tube 215 at the bottom of the tube 215 permitting the bayonet socket to have a double wall thickness to prevent bending of the socket as a result of the load transmitted to the socket when the bayonet socket is engaged. A lever 245 is affixed outside the service stack to each of the stainless steel tubes 215 of leads 105 and 109. Lever 245 is used to manipulate the bayonet sockets 241 to engage the pins 197 and 199 of the vertical terminal rods 193 and 195, respectively. When the bayonet sockets are engaged with the pins, nut 225 is rotated using a spanner wrench (not shown), while holding the copper bar from rotating by means of a lever 247 affixed to the copper rod 213 (outside the stack) to force the copper rod end down the stainless steel tube 215, in contact with the serrated top of vertical rod 193 or 195 at high pressure. The bottom end of the copper rod is coated with a soft metal such as indium, typically 0.010–0.020 inches thick. To assure a low resistance connection the high pressure engagement allows the contacts to break through heavy frost and establish low contact resistance. The correction coils are connected to the retractable leads by pushing the conduit 107 into the stack so that the tapered perimeter of the two halves of the multipin connectors 183 and 221 together with the keys and keyways on the multipin connector assure an aligned joining of the male and female multipin connectors.

During installation the insert 15 is slid into the cryostat penetration 13 with the concentric tubes 115 and 117 situated inside electrical lead assembly 21 and the spring loaded valve 121 at the end of the concentric tubes situated in the cryostat fill tube termination block 135. The open end of the isothermal envelope 59 surrounds the electrical lead assembly 21 and extends into the helium vessel 33 of the cryostat 11. The insert flange 57 is bolted to the cryostat flange 53. A vacuum is created between the outside of the 4° K. isothermal envelope 59 and the insert housing by evacuating the air by means of pump out port 75. During magnet cooldown it is desirable to supply liquid helium to the bottom of the helium vessel 33 of the cryostat. This is accomplished by retracting the insert 15 approximated ¼", by loosening the bolts at the flange connection closing valve 145 and exposing holes 159. A tube (not shown) is inserted inside tube 112 located in the slant fill tube 31 and liquid helium flows down the inserted tube and through the inner of the two concentric tubes 115 to the termination block 135, down tube 157 to the bottom of the helium vessel 33. The valve is then opened by inserting the insert 15 an additional ¼" causing any additional helium added after initial cooldown to flow into the top of the helium vessel. The tube is removed from the slant tube.

With the cryostat helium vessel filled with helium and the nitrogen shield filled by a separate insert (not shown), insert 15 is able to maintain a 4° K. environment within the 4° K. envelope 59.

Helium vapor flow spiralling in the clearance gap between the insert housing and the inner portion of cryostat penetration tube 45 intercepts heat conducted into the cryostat penetration 13 from ambient temperature. To reduce heat transfer from the ambient temperature surrounding the housing 23*a* and 23*b* of the insert a vacuum surrounds the inner 4° K. envelope 59 and the two copper radiation shields 61 and 63 are heat stationed to the shields 41 and 43 of the cryostat 11 and shields 61 and 63 are heat stationed in the vertical stack 25. The vertical stack has a vapor cooled inside tube 83 with a spiral vapor path to cool the 4° K. envelope extending partway up the vertical stack. The vapor cooling provided by the spiral grooves of tube help maintain shield 61 below 40° K. and shield 63 heat stationed further up the stack below 80° K. by force convection. The vertical arrangement of the stack also benefits from helium stratification, keeping the colder helium at lower levels in the stack. Bellows 77 accommodate the axial thermal contraction which occurs during cooldown between the housing 23*a* and 23*b* and the 4° K. envelope 59.

To energize the magnet 35, the electrical connections are made by lowering from the upper portion of the vertical stack the multipin connector 221 to engage its mating half 183. The power leads 105 and 107 are lowered and rotated to engage the horizontal pins 197 and 199 in the vertical terminated rods 193 and 195. The nut 225 is rotated and the copper rods 213 are lowered in the stainless steel tubes 215 with the soft indium metal at the bottom of the copper rods forced against the serrated tops of the vertical terminal rods 193 and 195 forming a good electrical connection. During energization, helium vapor cooling is used to cool the electrical lead assembly of the cryostat 21 and the copper rods 213. Vents 218 at the ends of the copper rods are opened allowing vapor to flow inside the stainless steel tube which are vented outside the insert.

When power is supplied to the magnet windings 35 the main power leads 105 and 109 and the leads of the cryostat lead assembly 21 are not superconductive and helium vapor cooling allows large current to be supplied to the windings in the cryostat while minimizing helium vapor loss and not permitting air to enter the cryostat. When the desired superconducting currents have been established in the cryostat the main power leads 105 and 109 can be disconnected from outside the insert and the leads withdrawn to the warmer top portion of the vertical stack 25 to reduce conduction heat losses. Vent valves in the vents 218 of the copper rods 213 are closed.

During operation of the magnet in the persistent current mode helium vapor is vented from tube 93 in the vertical stack and the bleed off nozzle 123 on the slant horizontal fill tube, as well from the flange 53. Helium vapor can be recovered from the outer concentric tube 117 through housing 113 and returned through the slant tube by using a liquifier (not shown) which has tube portions which extend down the slant tube and receive vapor from the aperture in housing 113 and return liquid helium down the center of the slant tube to the inner of the two concentric tubes 115. When a liquifier is not used in the persistent current mode a thin wall tube of low heat conductivity material, such as fiberglass, filled with styrofoam is inserted in the slant fill tube closing off the aperture leading to the center concentric tube 115. The space between the outside of the inserted tube and tube 112 of the slant fill tube permits vented helium to flow from the outer concentric tube 117. Shimming coil corrections can be made by lowering the multipin connector without changing inserts or admitting air into the insert.

The foregoing describes a single horizontal penetration insert with a vertical service stack through which the magnet can be powered or operated in a persistent mode without admitting air inside the helium vessel. The insert provided also functions as an interface between the cryostat and a helium liquifier.

While the invention has been particularly shown and described with reference to a preferred embodiment thereof, it will be understood by those skilled in the art that various changes in form and detail may be made without departing from the spirit and scope of the invention.

What is claimed is:

1. An insert for a cryostat having a horizontal penetration, the cryostat having an inner supercoolable vessel, an outer wall, at least one radiation shield situated between the supercoolable vessel and the outer wall and electrical leads extending through the cryostat penetration to the exterior of the cryostat, said insert comprising:

an outer tubular low thermal conductivity housing including a generally horizontal portion having a first and second section, said first section having an open end and adapted to be inserted inside said horizontal penetration extending through said cryostat outer wall, said radiation shield and inside said inner supercoolable vessel, said first and second section adapted to surround said electrical leads extending from the cryostat, said outer tubular housing further including a first tubular portion extending vertically from the second section of said horizontal portion so that access to said electrical leads outside the cryostat can be provided and a second tubular portion extending perpendicularly from the second section of the horizontal portion of the outer housing;

a cover securing the top of the vertical tubular portion;

an inner housing situated inside said outer tubular housing, said inner housing defining an opening at the end of the first section of said horizontal portion, the open ends of said first section and said inner housing being joined together, said inner housing adapted to surround said cryostat electrical leads, said inner housing extending part way up said vertical tubular portion and opening into said vertical tubular portion;

two concentric tubes situated in said first and second section of the inner housing and extending beyond the end of said first section of the outer tubular housing, said concentric tubes adapted to fit through said cryostat electrical leads and extend into said supercoolable cryostat vessel, said outer concentric tube defining holes in the portion situated in the second section;

a vent tube situated in said second tubular portion of said housing, said vent tube penetrating said inner housing and in flow communication with the outer of said two concentric tubes;

means for coupling liquid gas to said inner concentric tube through said vent tube;

a radiation shield situated between said horizontal portion of said outer housing and said inner housing, said shield extending partway up said vertical stack and heat stationed to said inner housing partway up said stack; and electrical connection means extending through said cover down said vertical tubular portion, said electrical connection means adapted to be coupled to said cryostat electrical leads.

2. The apparatus of claim 1 further comprising means for flexibly supporting the portion of said inner housing extending part way up said vertical tubular portion to said vertical tubular housing to accommodate relative longitudinal motion of said inner housing relative to said outer housing.

3. The apparatus of claim 2 wherein said means for flexibly mounting comprises a cylindrical bellows secured at one end to said inner housing and secured at the other end to said vertical tubular housing portion.

4. The apparatus of claim 2 wherein said space between the outside of the inner housing and the inside of the outer housing defines on evacuable volume.

5. The apparatus of claim 1 further comprising a burst disk located in the upper portion of the vertical tubular portion.

6. The apparatus of claim 1 further comprises a tube defining spiral grooves on its outer surface situated inside and in contact with the portion of said inner housing extending part way up said vertical tubular portion, the upper end of the spiral groove vented to the outside of said outer housing.

* * * * *